US006187163B1

(12) United States Patent
Miller et al.

(10) Patent No.: US 6,187,163 B1
(45) Date of Patent: Feb. 13, 2001

(54) METHOD FOR PLUTONIUM-GALLIUM SEPARATION BY ANODIC DISSOLUTION OF A SOLID PLUTONIUM-GALLIUM ALLOY

(75) Inventors: William E. Miller, Naperville; Zygmunt Tomczuk, Lockport, both of IL (US)

(73) Assignee: The United States of America as represented by the United States Department of Energy, Washington, DC (US)

( * ) Notice: Under 35 U.S.C. 154(b), the term of this patent shall be extended for 0 days.

(21) Appl. No.: 09/206,959

(22) Filed: Dec. 8, 1998

(51) Int. Cl.[7] ..... C25C 1/22; C25C 3/34
(52) U.S. Cl. ..... 205/44
(58) Field of Search ..... 205/43–44, 354, 205/357, 363–367; 204/243.1

(56) References Cited

U.S. PATENT DOCUMENTS

| | | | | |
|---|---|---|---|---|
| 3,417,002 | * | 12/1968 | Leary et al. | 205/44 |
| 4,596,647 | | 6/1986 | Miler et al. | 205/44 |
| 4,880,506 | * | 11/1989 | Ackerman et al. | 205/44 |
| 5,443,705 | * | 8/1995 | Miller et al. | 205/44 |

OTHER PUBLICATIONS

Hibbert, D.B. et al. Dictionary of Electrochemistry, John Wiley & Sons, New York, 1984, no month available.*

*Abstract: Electrochemcial Processing using Cadmium Electrodes*, Z. Tomczuk, J.J. Heiberger, and W.E. Miller, 19th Annual Actinide Separations Conference, Monterey, California, Jun. 12–15, 1995.

* cited by examiner

*Primary Examiner*—Kathryn Gorgos
*Assistant Examiner*—Wesley A. Nicolas
(74) *Attorney, Agent, or Firm*—Bradley W. Smith; Mark P. Dvorscak; William R. Moser

(57) ABSTRACT

Purified plutonium and gallium are efficiently recovered from a solid plutonium-gallium (Pu—Ga) alloy by using an electrorefining process. The solid Pu—Ga alloy is the cell anode, preferably placed in a moving basket within the electrolyte. As the surface of the Pu—Ga anode is depleted in plutonium by the electrotransport of the plutonium to a cathode, the temperature of the electrolyte is sufficient to liquify the surface, preferably at about 500° C., resulting in a liquid anode layer substantially comprised of gallium. The gallium drips from the liquified surface and is collected below the anode within the electrochemical cell. The transported plutonium is collected on the cathode surface and is recovered.

18 Claims, 3 Drawing Sheets

ANODIC DISSOLUTION OF SOLID ALLOY WHICH CONVERTS TO LIQUID PHASE

PHASE DIAGRAM OF THE SYSTEM PLUTONIUM–GALLIUM

METHOD FOR PLUTONIUM-GALLIUM SEPARATION BY ANODIC DISSOLUTION OF A SOLID PLUTONIUM-GALLIUM ALLOY

The United States Government has rights in this invention pursuant to Contract Number W-31-109-ENG-38 between the United States Government and Argonne National Laboratory, as represented by the University of Chicago.

TECHNICAL FIELD

The present invention relates to a method for separating gallium metal from plutonium utilizing an electrorefining process, wherein a solid plutonium-gallium (Pu—Ga) alloy comprises the cell anode and the gallium and plutonium are removed from a liquified surface on the solid Pu—Ga alloy. In particular, the plutonium in the anode surface is electrochemically oxidated, becoming part of the cell electrolyte, and the plutonium depleted surface liquifies and is effectively removed from the solid anode by the turbulence in the agitated electrorefining process.

BACKGROUND OF INVENTION

Fuel cycle technology has recently been adapted to aid in solving nuclear waste disposal problems. For example, weapons grade plutonium blended with uranium is converted into mixed oxide fuel to be burned in commercial light water reactors. Weapons grade plutonium, however, which is comprised of a plutonium-gallium (Pu—Ga) alloy, has presented significant problems when utilized directly as a reactor fuel, because the gallium, typically about 1 to 3 atom % of the Pu—Ga alloy, deleteriously effects fuel element-cladding chemistry. Therefore, development efforts have focused on processing Pu—Ga alloys to separate the gallium from the plutonium, prior to using the weapons grade plutonium in the fuel cycle.

Electrorefining processes are used to recover high purity metals from metal alloys containing impurities, such as plutonium from spent nuclear fuel. Electrorefining is performed in an electrochemical cell in which the fuel elements or fuel alloys form the anode, and a molten eutectic salt electrolyte is used to transfer select ions formed at the anode and discharged as purified metal to the cathode. The fuel elements may be dissolved in a liquid metal anode pool that is immiscible with the electrolyte, or disposed in a moveable basket for immersion in the electrolyte. FIG. 1 shows a prior art electrochemical cell (LANL design) having a non-conducting ceramic electrolyte container 16 containing a molten electrolyte salt 18 (preferably a chloride salt), a solid cathode cylindrical shell or ring 20 positioned within the electrolyte 18, and an anode made of impure molten plutonium 12 (e.g., Pu—Ga alloy) and contained in an inner ceramic crucible 14. The liquid anode is stirred by a ceramic agitator 24. During operation, the plutonium metal from the liquid anode pool is oxidized to form a salt (e.g., $PuCl_3$) at the anode-electrolyte interface, and the salt is transported within the electrolyte and reduced to plutonium metal at the cathode. The electrorefining process is operated above the melting point of plutonium, such that the purified liquid plutonium drips off the cathode ring and collects at the bottom 22 of the electrorefining cell in the annulus region.

By using the electrochemical cell shown in FIG. 1, approximately 90% of the plutonium metal is removed from the anode and recovered as purified cathode metal before the anode solidifies, preventing stirring of the anode and thus terminating the operation of the electrochemical cell (i.e., for a Pu—Ga alloy initially comprised of 1 wt % gallium, the anode solidifies after about 85% to 90% of the plutonium has been removed from the anode). The remaining 10% of the plutonium is part of the solidified ring of anode. The solidified anode, also referred to as the heel, is a process waste made of impure plutonium (about 25 atom % Ga and about 75 atom % Pu) and must be subjected to further processing. Additional problems include migration of impurities toward the salt-anode interface where the plutonium oxidation is occurring, and limits on the solubility of the impurity within the liquid plutonium. For example, in the case of a gallium impurity, the Pu—Ga intermetallic compound blocks or clogs the liquid salt-liquid metal interface and prevents further electrolysis. Although stirring the anode with a ceramic stirrer 24 increases the amount of liquid plutonium at the salt-anode interface, breakage of the stirrer 24 occurs at a high frequency, after the Pu—Ga anode begins to solidify.

Another electrorefining process for separating plutonium from gallium involves dissolution of the Pu—Ga alloy in a liquid cadmium anode. The Pu—Ga alloy is dissolved in the liquid cadmium anode of the electrochemical cell, and plutonium ions are transported by an electrolyte to a solid cathode where solid plutonium metal dendrites form, or, alternatively, to a liquid cadmium cathode. This cadmium diluted anode electrorefining process operates at a temperature of about 500° C., well below the melting point of plutonium, and is a single phase liquid system for all compositions. Where a liquid cadmium cathode is used, pure plutonium is recoverable by distillation. This approach requires little stirring, since the salt-metal pool anode interface does not become blocked with solids; after repeated cycles, however, gallium accumulates in the gallium-cadmium (Ga—Cd) anode pool, and the gallium to cadmium ratio in the anode is great enough to inhibit dissolution of Pu—Ga alloys. The Ga—Cd liquid anode is then retorted to separate the volatile cadmium from the non-volatile gallium. The cadmium condensate is recycled, and the gallium is recovered and may be used for producing Pu—Ga alloys.

Electrorefining spent fuel containing gallium has significant corrosion and process limitations. For example, ferrous metal is vigorously attacked by intergranular diffusion and compound formation caused by the gallium in temperatures between about 400° C. and 500° C. Gallium also forms very strong compounds with uranium, plutonium, and alkali, alkaline earth, rare earth, and some noble metals. Gallium effects distribution coefficients and separation factors, and, although gallium does not oxidize into salt, its alloying properties also effect electrorefining separation processes used to recycle spent fuel. Therefore, it is desirable to separate the gallium from the plutonium prior to using Pu—Ga alloys to produce fuel.

The invented method for separating gallium from Pu—Ga alloys disclosed herein uniquely employs a solid anode for significantly improving the overall rate of electrotransfer by four to ten times the state of the art. The method involves moving a solid Pu—Ga alloy anode in liquid electrolyte at a temperature sufficient to cause a liquid layer to form on the surface of the solid Pu—Ga alloy (e.g., 500° C.). The surface plutonium is oxidized and effectively stripped from the surface layer until only gallium essentially remains. The plutonium is electrotransported to a cathode and recovered in a purified form. The liquid gallium drips from the surface and is collected at the bottom of the electrorefining cell.

Therefore, in view of the above, a basic object of the present invention is to provide an efficient method for separating impurities from plutonium.

Another object of this invention is to provide an electrorefining method for separating plutonium and gallium from a Pu—Ga alloy, wherein essentially pure plutonium is recovered.

Another object of this invention is to provide a one step electrorefining method for separating plutonium and gallium from a Pu—Ga alloy that does not produce a waste product containing plutonium, requiring further processing.

Yet another object of this invention is to provide a method for processing a Pu—Ga alloy that overcomes anode solidification problems experienced in the prior art.

BRIEF SUMMARY OF THE INVENTION

Briefly, this invention is an efficient process for recovering plutonium from a solid plutonium-gallium (Pu—Ga) alloy. An electrorefining cell is employed, and the solid Pu—Ga alloy is used directly as a moving anode, preferably placed in a basket and immersed in liquid electrolyte at a temperature of about 500° C. This temperature is sufficient to cause a liquid layer to form on the surface of the solid Pu—Ga alloy, when the composition of the surface layer is changed by the removal of plutonium from the surface by oxidation. Plutonium is electrotransported to a cathode, while the gallium drips from the liquified surface and collects at the bottom of the electrorefining cell. The cathode is initially a support surface, preferably comprised of iron, and the transported plutonium deposits as a solid (the melting point of plutonium is 640° C.) on the cathode surface and is recovered. The voltage is controlled to prevent gallium from forming a salt within the electrolyte, with an upper limit of about −0.9 V for driving the electrorefining cell.

A great volume of Pu—Ga alloy may be treated expeditiously by using the present electrorefining cell and method, since there are no solid Pu—Ga pieces or heels remaining for further processing or other wastes requiring treatment. In addition, all of the gallium is recoverable in a liquid form suitable for producing additional plutonium-gallium alloys, if desired. In fact, the heels recovered from less efficient Pu—Ga separation processes may easily be treated by the present method by using the heels as the solid Pu—Ga anode. Finally, the plutonium is recovered in a convenient solid form by scrapping the plutonium dendritic solid from the cathode support. The solid, containing occluded salt, is melted and cast to separate the plutonium and salt into two layers, which are easily broken apart.

BRIEF DESCRIPTION OF THE DRAWINGS

Other objects, advantages, and novel features of the present invention will be apparent from the following detailed description and drawings herein described below.

DETAILED DESCRIPTION OF THE INVENTION

Figure 2:
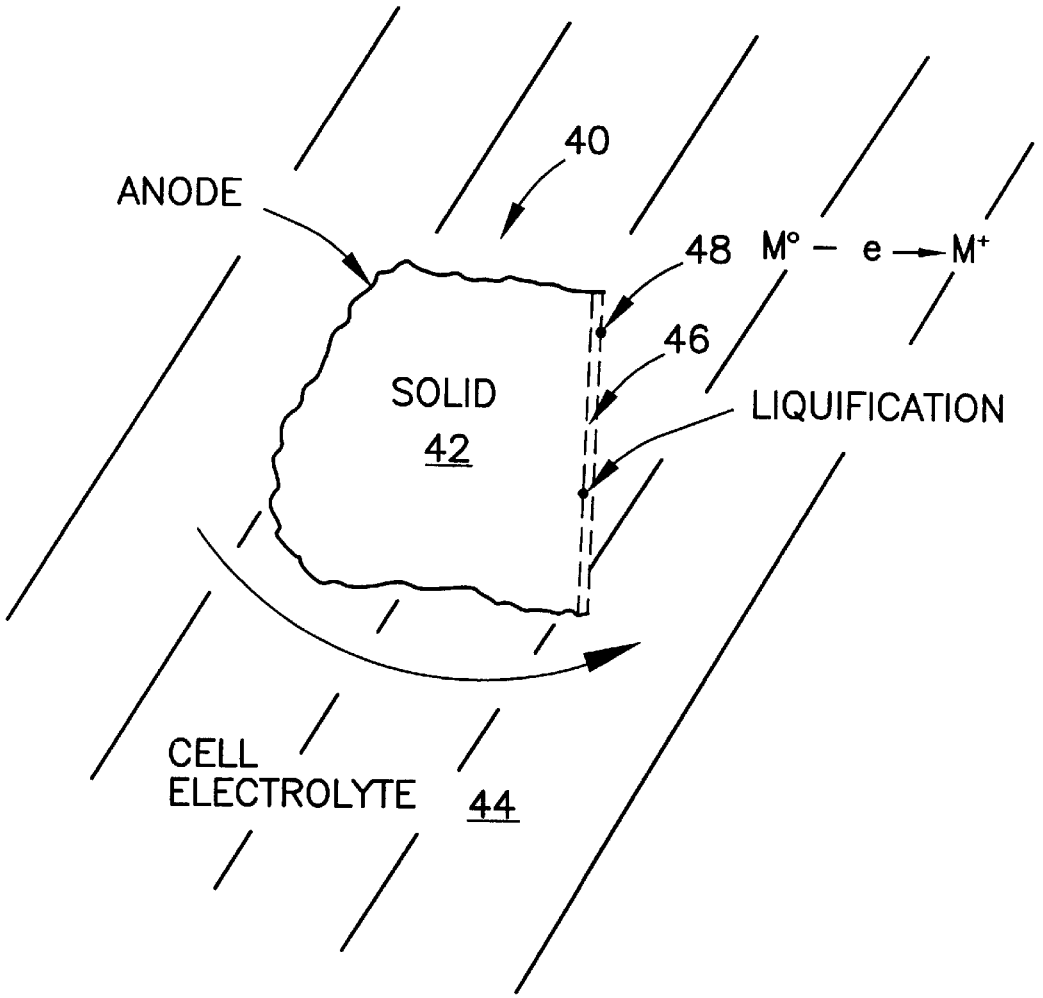
FIG. 2 shows the anodic dissolution of the solid Pu—Ga alloy according to the present method.

The present invention relates to a method for separating plutonium and gallium from a solid plutonium-gallium (Pu—Ga) alloy by solid anodic dissolution in an electrorefining process. As shown in FIG. 2, solid anodic dissolution 40 of the Pu—Ga alloy is accomplished in an electrorefining cell by disposing a solid Pu—Ga alloy 42 in a molten electrolyte 44, such that the solid Pu—Ga alloy 42 forms the cell anode. Preferably, the solid Pu—Ga anode is placed in baskets that are connected to a power supply and immersed in and moved through the molten electrolyte 44. A solid cathode 50 is also provided within the electrorefining cell. Alternatively, a liquid cathode may be employed. The cathode is in contact with the electrolyte and is preferably located at a point above the solid Pu—Ga alloy.

In operation, the electrorefining cell is maintained at a temperature sufficient to cause a liquified layer 46 to form on the surface of the solid Pu—Ga alloy, as the plutonium is electrochemically stripped from the surface of the anode and the composition of the surface layer 46 changes. In other words, the plutonium in the surface is electrotransported to the cell cathode, leaving a substantially gallium surface behind that liquifies at the electrorefining cell temperature. Preferably the electrorefining cell is operated at a temperature of about 500° C. Current is passed through the electrorefining cell, causing the metal plutonium (M) component of the surface of the solid Pu—Ga alloy to initially oxidize, and then to oxidize at the interface 48 between the created liquified layer 46 and the electrolyte 44 (e.g., $M^{\circ} - e \rightarrow M^{+}$). This surface oxidation occurs very rapidly, and the plutonium is effectively electrotransported to the cell cathode. The liquid gallium component of the Pu—Ga alloy is removed from the liquified surface 46, as it drips from the surface and collects below the solid Pu—Ga anode, preferably at the bottom of the electrorefining cell. The liquified layer is essentially being scrubbed off the solid Pu—Ga anode by the washing action of the electrolyte and gravitational forces, as the metal is heavier than the electrolytic salt. Importantly, at the time the dripping liquid layer loses electrical contact with the solid Pu—Ga alloy anode 42, the liquid is essentially depleted of plutonium and is comprised essentially of gallium.

Any Pu—Ga alloy may be separated according to the present method, including weapons grade plutonium in the range of between about 1 and about 3 atom % gallium, and anode heels produced by known electrorefining processes generally in the range of between about 18 and about 22 atom %. Large pieces of the Pu—Ga alloy may be used, or, alternatively the Pu—Ga alloy may be subdivided into smaller pieces prior to anodic dissolution.

The molten electrolyte is preferably a eutectic chloride salt, e.g., LiCl, KCl, among others. $PuCl_3$ may be added to the electrolyte to ensure efficient electrotransport of plutonium from the anode to the cathode within the electrorefining cell. Alternatively, an oxidant, including but not limited to $CdCl_2$, FeCl, CuCl, and/or Cl, may be added to the electrolyte to chemically react with the plutonium, forming $PuCl_3$.

Figure 1:
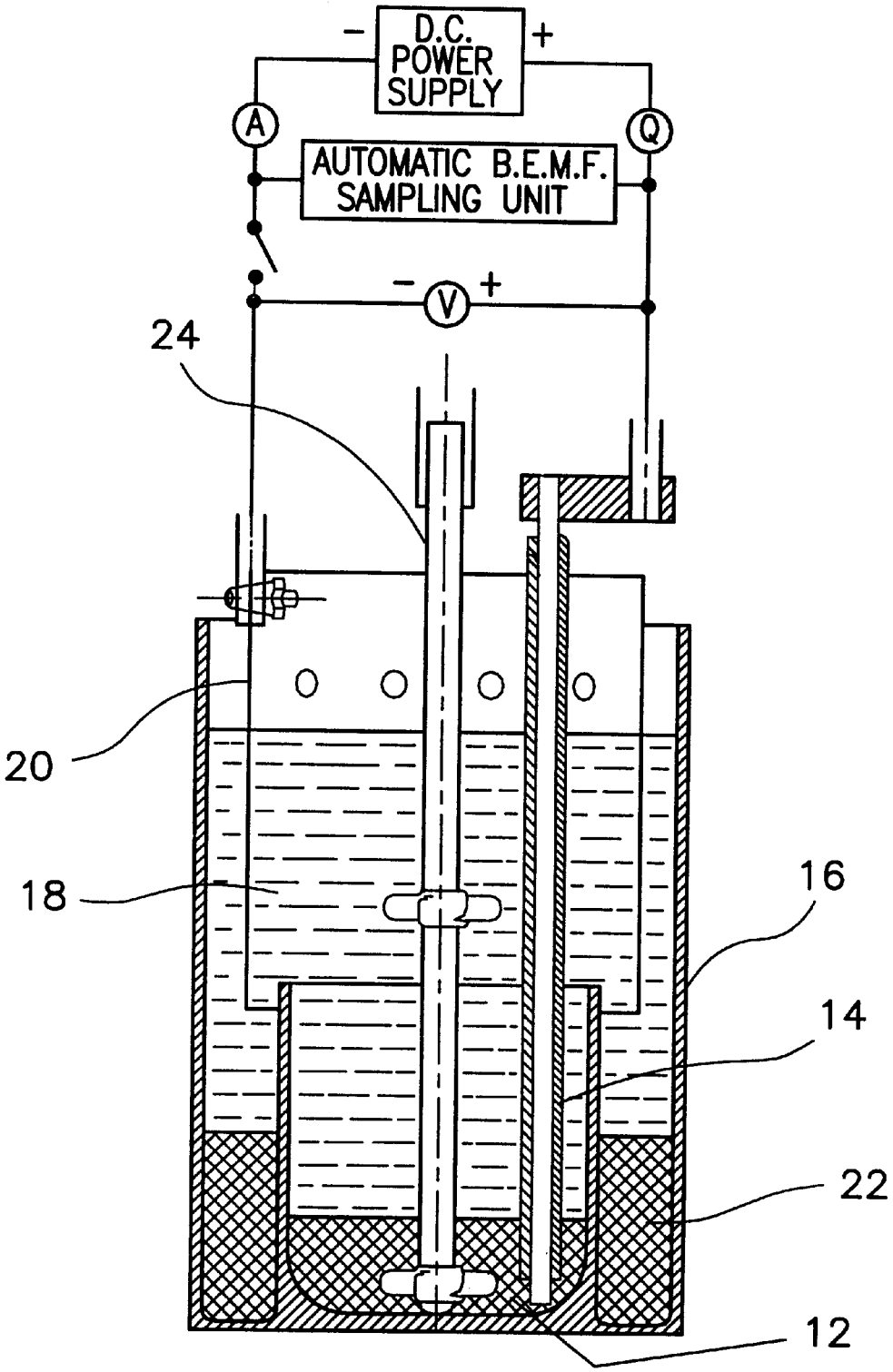
FIG. 1 PRIOR ART
FIG. 1 shows a prior art electrorefining cell design employing a liquid plutonium-gallium (Pu—Ga) anode, which solidifies as the overall composition of the anode is changed by the plutonium removal.
Figure 3:
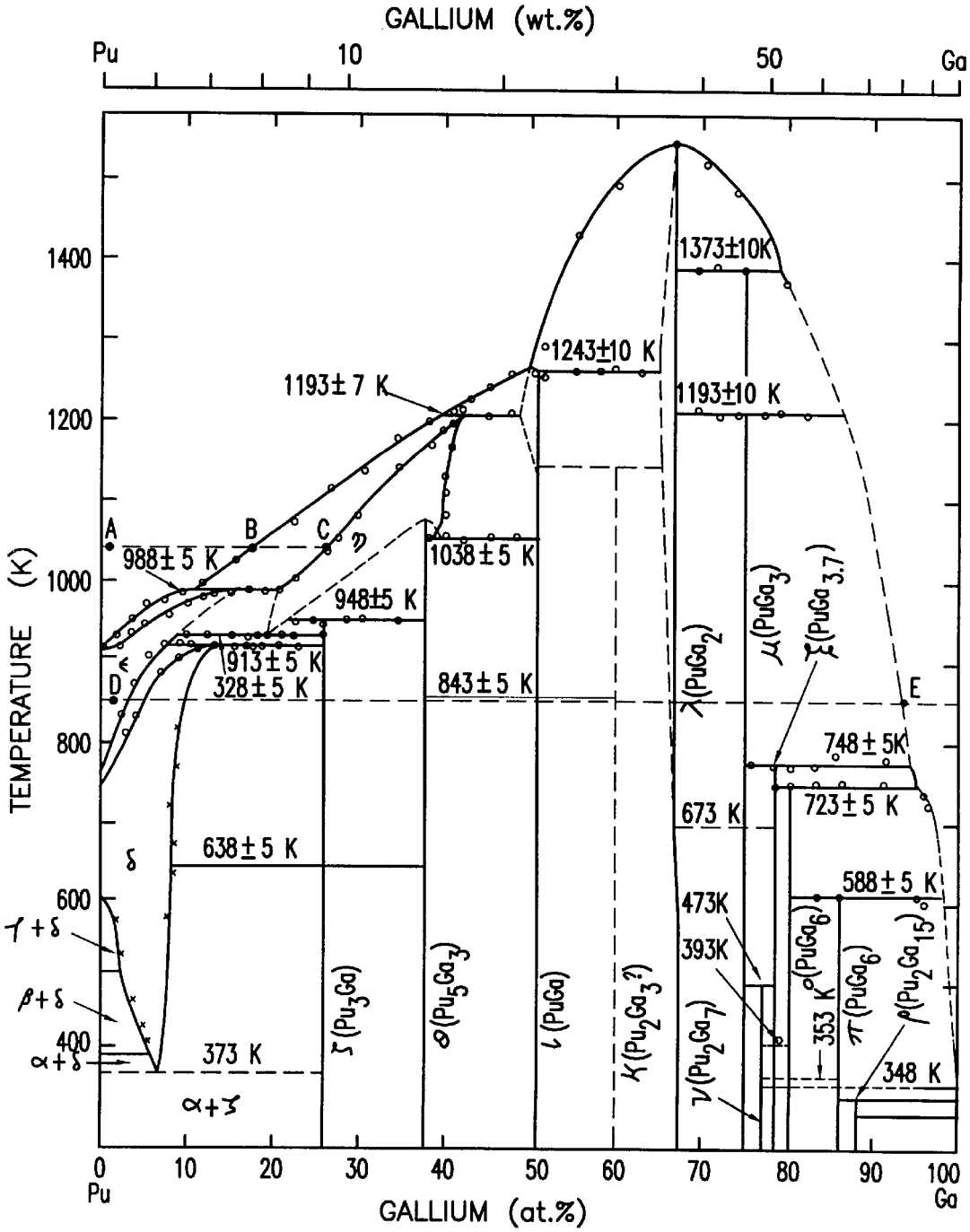
FIG. 3 is a phase diagram of a plutonium-gallium (Pu—Ga) system.

FIG. 3 is a phase diagram of the plutonium-gallium system illustrating the relationships between temperature and the phase compositions. The Pu—Ga alloy is a solid at 97 atom % plutonium and 773° K (500° C.), near point D. As plutonium is removed from the surface of the solid Pu—Ga alloy by anodic oxidation, the surface layer liquifies at a composition of about 8 atom % plutonium, near point E. The advantage of employing a solid Pu—Ga anode is that all the plutonium is recoverable in a single separation step. If the Pu—Ga alloy is melted in the anode, as in the electrorefining process illustrated in FIG. 1, the initial anode composition is represented by point A on FIG. 3. As plutonium is removed from the stirred anode, its composition moves from point A to point B, where solids will begin to form. As even more plutonium is removed, the composition continues to move from point B toward point C—complete solidification. Electrorefining processes employing a liquid anode are therefore limited at a certain point between point B and C, where stirring can no longer be performed due to the solidification. The present method overcomes this limitation.

The electrorefining cell voltage is controlled to prevent gallium from forming a salt within the electrolyte, with an upper limit of −0.9 V, as the driving voltage. For example, if the Pu—Ga alloy is initially 97 atom % plutonium and a solid cathode is used, then to recover 99.999% of the plutonium the composition of liquid gallium leaving the anode is $3.2\times10^{-4}$ mol fraction plutonium, requiring a voltage of −0.73 volts. To further reduce the plutonium content of the gallium to $3.2\times10^{-6}$ mol fraction plutonium, a voltage of −0.84 volts is required, resulting in a gallium stream containing only 10 ppm by weight plutonium.

Electrorefining cell designs known in the art may be employed to practice the present method. Preferably, the design for practicing anodic dissolution of the solid Pu—Ga alloy disposes the anode and cathode in close proximity to reduce cell resistance and employs a movable anode basket device for immersing the solid Pu—Ga alloy in the electrolyte. The movement of the anode through the electrolyte is desirable to facilitate continuous washing or scrubbing of the liquid layer from the solid Pu—Ga alloy anode, whereupon a fresh liquid surface is formed.

It is appreciated by one skilled in the art that this method may be similarly employed to purify other plutonium alloys.

The present one-step, high through-put method minimizes waste products and streams, operates at a lower temperature than prior art methods, and is easily controlled by maintaining the voltage through the electrorefining cell. Additional advantages include use of the solid phase of the Pu—Ga alloy, extended liquid surface area available for oxidation of the plutonium at the metal-salt interface, and the recovery of the gallium and plutonium, without formation of a Pu—Ga alloy waste solid, or heel, or necessity for further separation steps.

While preferred embodiments of the present invention have been shown and described in detail above, it would be clear to those skilled in the art that many changes and modifications are possible without departing from the invention in its broader aspects, as set forth in the appended claims. Accordingly, all such modifications are intended to be included within the scope of this invention.

What is claimed is:

1. A method for separating plutonium and gallium from a solid plutonium-gallium alloy utilizing an electrochemical cell, comprising the steps of:

employing the solid plutonium-gallium alloy as an anode in the electrochemical cell, selecting a molten electrolyte or an electrolytic medium for the electrochemical cell where the electrolyte has a density less than that of gallium, maintaining a cell driving voltage below −0.9v in order to prevent the gallium from forming a salt within the electrolyte, electrotransporting plutonium from the anode through the electrolyte to a cathode;

maintaining the cell at a temperature such that as plutonium ions migrate from a surface of the solid alloy a thin film of essentially liquid gallium forms on the surface of the solid alloy, allowing the liquid gallium to flow off of the surface of the alloy and collect under the solid anode.

2. The method according to claim 1, further comprising the step of maintaining the electrochemical cell at a temperature of about 500° C.

3. The method according to claim 1, wherein the electrolytic medium is a molten eutectic salt selected from the group consisting of lithium chloride and potassium chloride.

4. The method according to claim 1, further comprising the step of adding plutonium chloride to the electrolytic medium.

5. The method according to claim 1, further comprising the step of adding an oxidant to the electrolytic medium, wherein the oxidant is selected from the group consisting of cadmium chloride, iron chloride, and copper chloride.

6. The method according to claim 1, further comprising the step of controlling the voltage within the electrochemical cell to determine the rate of electrotransportation of the plutonium, prevent liquid gallium from forming a salt within the electrolytic medium, and substantially eliminate any plutonium from the collected liquid gallium.

7. The method according to claim 1, wherein the solid plutonium-gallium alloy is comprised of gallium in the range of between about 1 atom percent and about 3 atom percent.

8. The method according to claim 1, wherein the solid plutonium-gallium alloy is comprised of gallium in the range of between about 18 atom percent and about 22 atom percent.

9. The method of claim 1 wherein the solid alloy anode is moved through the electrolyte to wash the liquid gallium from the surface of the alloy thereby exposing a fresh surface.

10. The method of claim 1 wherein the solid alloy is placed in a basket which is connected to an external power source and which together with the alloy forms the anode and is moved through the electrolyte thereby allowing the electrolyte to flow over the solid alloy.

11. A method for separating plutonium and gallium from a solid plutonium-gallium alloy utilizing an electrorefining process, comprising the steps of:

providing an electrochemical cell having a molten electrolyte in contact with a cathode;

inserting an anode comprised of the solid plutonium-gallium alloy having a surface within the molten electrolyte and in a spaced relationship to the cathode;

establishing a voltage drop between the anode and the cathode;

transporting the plutonium from the surface of the solid plutonium-gallium alloy, through the molten electrolyte, and to the cathode, whereby the surface is substantially depleted of plutonium;

maintaining the molten electrolyte at a temperature sufficient to form a liquid layer on the plutonium depleted surface of the solid plutonium-gallium alloy, wherein the liquid layer is comprised of substantially of liquid gallium;

collecting the liquid gallium, as the liquid gallium drips from the liquid layer; and recovering purified plutonium from the cathode.

12. The method according to claim 11, wherein the molten electrolyte is maintained at a temperature of about 500° C.

13. The method according to claim 11, wherein the electrolyte is comprised of fused salt selected from the group consisting of lithium chloride and potassium chloride.

14. The method according to claim 11, further comprising the step of adding an oxidant to the molten electrolyte, wherein the oxidant is selected from the group consisting of cadmium chloride, iron chloride, and copper chloride.

15. The method according to claim 11, wherein the solid plutonium-gallium alloy is comprised of gallium in the range of between about 1 atom percent and about 3 atom percent.

16. The method according to claim 11, wherein the solid plutonium-gallium alloy is comprised of gallium in the range of between about 18 atom percent and about 22 atom percent.

17. The method according to claim 11, wherein the voltage drop between the anode and the cathode is less than about −0.9 volts.

18. The method of claim 11 wherein the solid alloy anode is moved through the electrolyte to wash the liquid gallium from the surface of the alloy thereby exposing a fresh surface.

* * * * *